US007621563B1

(12) United States Patent
Mitchell

(10) Patent No.: US 7,621,563 B1
(45) Date of Patent: Nov. 24, 2009

(54) POCKET SIZED SKI TRANSPORT APPARATUS

(76) Inventor: Jeanne Mitchell, 5206 Fairway Dr., San Angelo, TX (US) 76904

( * ) Notice: Subject to any disclaimer, the term of this patent is extended or adjusted under 35 U.S.C. 154(b) by 267 days.

(21) Appl. No.: 11/873,563

(22) Filed: Oct. 17, 2007

Related U.S. Application Data

(60) Provisional application No. 60/853,664, filed on Oct. 23, 2006.

(51) Int. Cl.
*A63C 11/02* (2006.01)

(52) U.S. Cl. ..... 280/814; 280/79.7; 294/147

(58) Field of Classification Search ..... 280/79.7, 280/652, 809, 814, 815; 294/31.2, 147
See application file for complete search history.

(56) References Cited

U.S. PATENT DOCUMENTS 3,262,619 A * 7/1966 Selnes ..... 294/147
3,504,405 A * 4/1970 Elliott-Smith ..... 70/58
4,274,571 A * 6/1981 Lafreniere et al. ..... 294/147
4,852,931 A * 8/1989 Ferdi ..... 294/147
6,086,102 A * 7/2000 Stark et al. ..... 280/814
6,848,718 B2 * 2/2005 Ravikumar et al. ..... 280/814
2007/0222168 A1 * 9/2007 Sellers et al. ..... 280/79.7

FOREIGN PATENT DOCUMENTS

FR 2604634 A1 * 4/1988

* cited by examiner

*Primary Examiner*—Paul N Dickson
*Assistant Examiner*—John D. Walters
(74) *Attorney, Agent, or Firm*—Buskop Law Group, PC; Wendy Buskop

(57) ABSTRACT

A pocket sized ski transport apparatus having a separator for supporting a plurality of skis and having supporting a first extension spaced apart from a second extension and an axel connecting the extensions with at least one roller on the axel and wherein the separator has a first, second and third separator holes. A separator strap disposed through the third separator hole. A first block non-removably engaging the separator strap on one end and a second block non-removeably engaging the second end. Each block also having a pair of vertical parallel block holes and a perpendicular hole horizontal to the vertical block holes. A ski securing strap engaging each pair of vertical block holes having a buckle and engaging each of the first and second separator holes.

15 Claims, 9 Drawing Sheets

POCKET SIZED SKI TRANSPORT APPARATUS

CROSS REFERENCE TO RELATED APPLICATIONS

The present application claims priority to U.S. Provisional Patent Application Ser. No. 60/853,664 filed on Oct. 23, 2006.

FIELD

The present embodiments relate to a small and light transport device enabling a user to roll at least one pair of skis easily along a surface, such as a parking lot at a ski resort.

BACKGROUND

A need exists for a ski transport device that is lightweight, easy to pack and easy to install on a pair of skis, so that a user can trolley the skis easily along a rugged pebble strewn parking lot without having to carry the skis on their shoulders.

The present embodiments meet these needs

BRIEF DESCRIPTION OF THE DRAWINGS

The detailed description will be better understood in conjunction with the accompanying drawings as follows.

Figure 1:
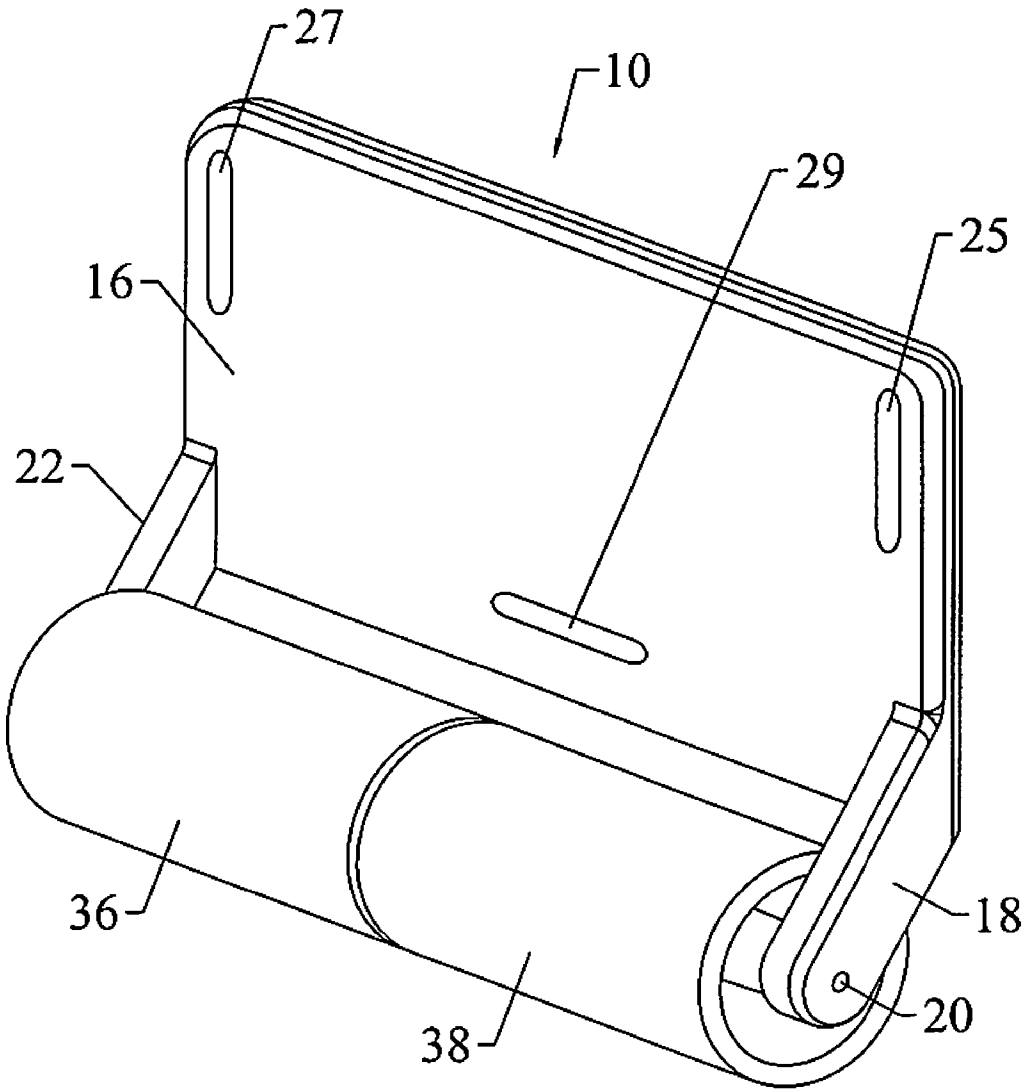
FIG. 1 is a front perspective view of the transport device without straps or blocks.

The present embodiments are detailed below with reference to the listed Figures.

DETAILED DESCRIPTION OF THE EMBODIMENTS

Before explaining the present apparatus in detail, it is to be understood that the apparatus is not limited to the particular embodiments and that it can be practiced or carried out in various ways.

The embodiments relate to a small, pocket sized, lightweight, molded plastic device that can be used to roll at least one pair of skis over the ground with the ground not touching the skis.

It is contemplated that the device would weigh less than about 0.3 pounds and as little as 4 ounces.

In an embodiment of the device, the pocket sized ski transport apparatus can include a separator for supporting a plurality of skis in a substantially parallel orientation to one another in a substantially common plane.

More specifically, it is contemplated that the pocket sized ski transport apparatus has a separator with a first extension spaced apart from a second extension.

In an embodiment, it is contemplated that the separator is a one piece molded unit having a base with a first extension extending from the base on one side and a second extension extending from the base on the same surface as the first extension, but on a side opposite and parallel to the first extension.

Between the first extension and second extension an axel is disposed connecting the extensions. The axel can be formed of at least one, possibly two solid rods, each with a head. The head can be a starlock push cap pushed onto a single stainless steel unthreaded shaft and additionally secured by an adhesive.

The rod of the axel can penetrate through a hole made in each extension. The head would act as a stop for at least one of the extensions, preventing the axel from falling out of the orientation between the extensions. On the other end of the rod, a fastener could hold the axel in place, or simply two pins, each with a head can be used to hold at least one roller onto the axel. More than one roller can be used on the axel.

It is contemplated that the rollers can be cylinders, made from a polymeric material, or a hard material that is covered. In a elastomeric material or other rubber like materials, such as rubber, the coating on the roller can enable the rollers to easily roll over small pebbles and not create marks on floors. The roller can be made of a polyamide or hard polypropylene/polyethylene material, which can enable the ski assembly to be very light weight. If a hard crystalline polymer is used, the rollers can be hollow and resist deformation, enabling a less expensive apparatus to be formed because less material is needed.

In an embodiment, the rollers can be encapsulated in a non-marking materials so that the rollers can be used in expensive lobbies of fine ski hotels.

The separator can have a first separator hole, a second separator hole and a third separator hole. In the embodiments shown in the Figures, the holes are ellipsoid holes enabling web material, or a Velcro™ to pass easily through the holes. Two holes can be disposed on either side of the separator and can be parallel to each other. The third hole is disposed generally perpendicular to the first two holes on a third side of the separator. These three holes are contemplated to be at the edges of the separator in an embodiment, rather than in the center.

A separator strap can be made of webbing, such as seat belt material, which can be disposed through the third separator hole. The separator strap can have two ends, the first end of the separator strap can engage a first block nonremovably. The separator strap, which is from about 2 inches to about 7 inches long can slip through a hole in the first block and be adhered or sewn to itself.

The separator strap can engage the first block on the first end and a second block on the second end. The separator strap is nonremovably secured to the first and second blocks, such as with adhesive, by sewing the strap to itself after the strap is passed through the block, or by using a fastener, such as a clip, button or snap.

In an embodiment the separator strap is between about 0.5 inches and about 1.5 inches wide with a minimal thickness.

Each block can have a pair of vertical parallel block holes that are perpendicular to the hole that engages the separator strap.

Each of the pair of vertical block holes can be ellipsoid as depicted in the Figures, but other shapes can be used as well.

One end of the ski securing strap can have a buckle nonremovably attached to the strap. The buckle can be a plastic generally circular, or D-shaped with a cut article. The buckle needs to be strong, to support pulling of the ski securing strap around the skis.

The ski securing strap can also pass through each of the first and second separator holes, passing around and encircling the separator without affecting the rolling of the rollers on the axel.

Each hole in the separator Is able to receive and hold one end of a ski securing strap that could be tensioned over the skis and connected to ski hardware, such as brakes, bindings or even to ski boots. The strap can also secure to itself, as the strap can be constructed to have a portion that is a Velcro™ like material, that is having a portion that is loop material and a portion that is hook material. The separator and the blocks can be hollow in an embodiment, to insure that the ski transport apparatus is a lightweight device.

The first extension and the second extension can protrude from the base on the same side of the base of the separator. Each extension can have a central hole at a point furthest from the base. The extensions can be triangular shaped or rectangular shaped. The holes can be circular or another shape, so long as the rod which is the axel can be supported by the holes. Angular holes provide a secure fit in an embodiment.

In an embodiment, the extension project at about a 130 degree angle from the base of the separator. It is possible the extensions can project from the separator base at an angle from about 120 degrees to about 170 degrees from the plane of the base of the separator.

In an embodiment, the extensions can have rounded edges, to insure smooth transport without marking the floor as the rollers traverse a floor.

In an embodiment, a roller can be cylindrical and can be supported by the axel secured between the first and second extensions. In another embodiment, the roller is a hollow one piece roller with an interior tube portion for supporting the at least one pin or rod that forms the axel. The roller can be a two part roller, with two segments, or a roller with a plurality of segments.

The pocket sized ski transport apparatus can have an overall width of less than about 4.5 inches and a height of less than about 4.5 inches Turning to FIG. 1, the pocket sized ski transport apparatus is shown having a separator 10. In this embodiment, the separator can be a molded article.

The separator 10 has a base 16 and a first extension 18 connected to the base and a second extension 22 connected to the base. In this embodiment, the extensions are depicted as being connected to the base at an angle of between 120 degrees and 140 degrees.

In an alternative embodiment, the first and second extensions can be components that are separately created and then adhered to the base with an adhesive or fastened to the base with L-shaped fasteners.

FIG. 1 also shows that the first extension 18 has a first hole 20 for engaging an axel for supporting the first roller 36 and the second roller 38. These extension are depicted as having an elliptical end or rounded end, with a rectangular body portion secured to the base. The extensions are intended to be mirror images of each other. The second hole 24 of second extension 22 is not shown in this Figure. FIG. 1 also shows the first separator hole 25 and the second separator hole 27 are parallel to each The third separator hole 29 is below the first separator hole 25 and the second separator hole 27. The separator holes are further shown on the edges of the separator 10.

Figure 2:
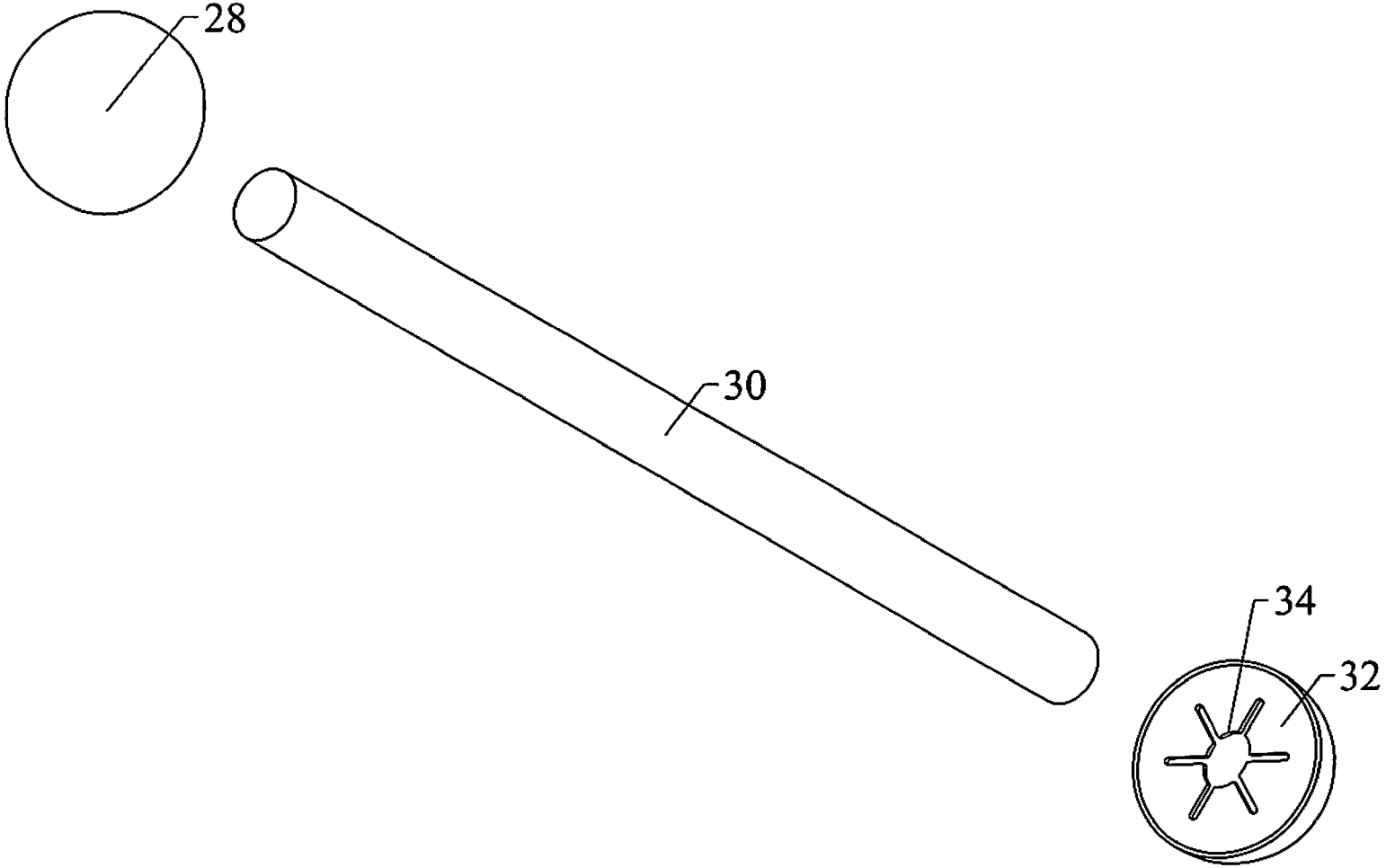
FIG. 2 is a side view of the shafts and heads used to create an axel.

FIG. 2 shows a view of the axel. In this embodiment, the axel is made from an assembly of a first head 28, a second head 32, and a shaft 30. The first head 28 is shown larger than first hole 20 and can be secured to a shaft 30 having a diameter.

The second head 32 is depicted and is larger than the second hole 24 and can be secured to a shaft 30. It is contemplated that the shaft can be made from solid metal or solid plastic, a laminate, or even a graphite composite for added toughness.

The second head 32 is depicted having a star shape hole 34. The first head can also have a star shaped hole. The first head 28 is initially secured to the shaft 30. The shaft 30 is pushed through the first hole 20 and through the first roller 36 and the second roller 38. Then the end of the shaft extends through the second hole 24 and the second head 32 is pressed onto the shaft 30.

The shaft 30 can be a machined steel bar or a extruded steel bar. The shaft 30 can also be made from a similar material with similar tensile strength and other material properties.

The first head and second head securely affix to shaft when pressed onto the shaft. The first head and second head can withstand at least 120 psi before separating from the shaft. An epoxy can be used to further increase pressure needed to separate the heads from the shaft. It is also contemplated that in an embodiment of the invention that the ends of the shaft can be threaded and the first head and second head can be held in place using a threaded fastener.

In another embodiment the shaft can be made of a first shaft and second shaft. The first and second shaft can have the same diameter but of different lengths. It is contemplated that they could be identical lengths and slightly different diameters, so long as the shafts fit through the first and second holes.

The overall length of the axel can be between about 2 inches and 5 inches. The length of the distance of the axel away from the based can be between about ¾ of an inch to about 1 and ¼ inch. For an embodiment of the ski transport apparatus, the axel can be about 3 inches from axel to the end of the base. In another embodiment, the axel can be stainless steel and can be threaded or unthreaded.

The roller should freely rolls under the weight of the skis around the axel.

Figure 3:
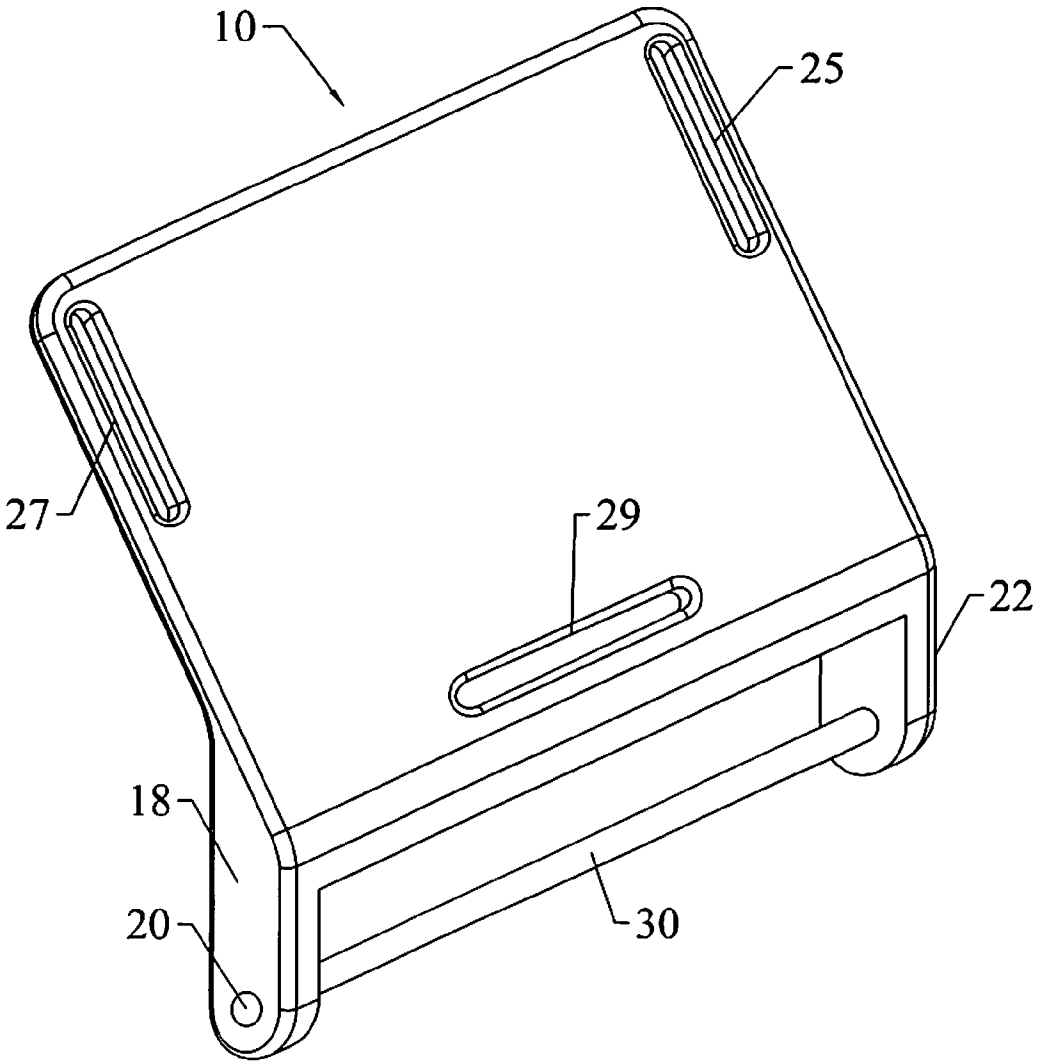
FIG. 3 is a top perspective view of a separator.

FIG. 3 is a top perspective view of the separator 10. The separator is shown here with first separator hole 25, second separator hole 27 and third separator hole 29. The length of each of these holes can be between about 1 inch to about 1 and ½ inches. The first extension 18 and second extension 22 are depicted. A one piece axel 30 is shown between the first and second extensions. The separator can have a thickness between about ⅛ inch to about ½ inch.

In this embodiment, it is contemplated that the distance between the first hole 20 and second hole 24 can be between about 3 inches to about 4 inches, which coincides generally with the width of a ski.

Figure 4:
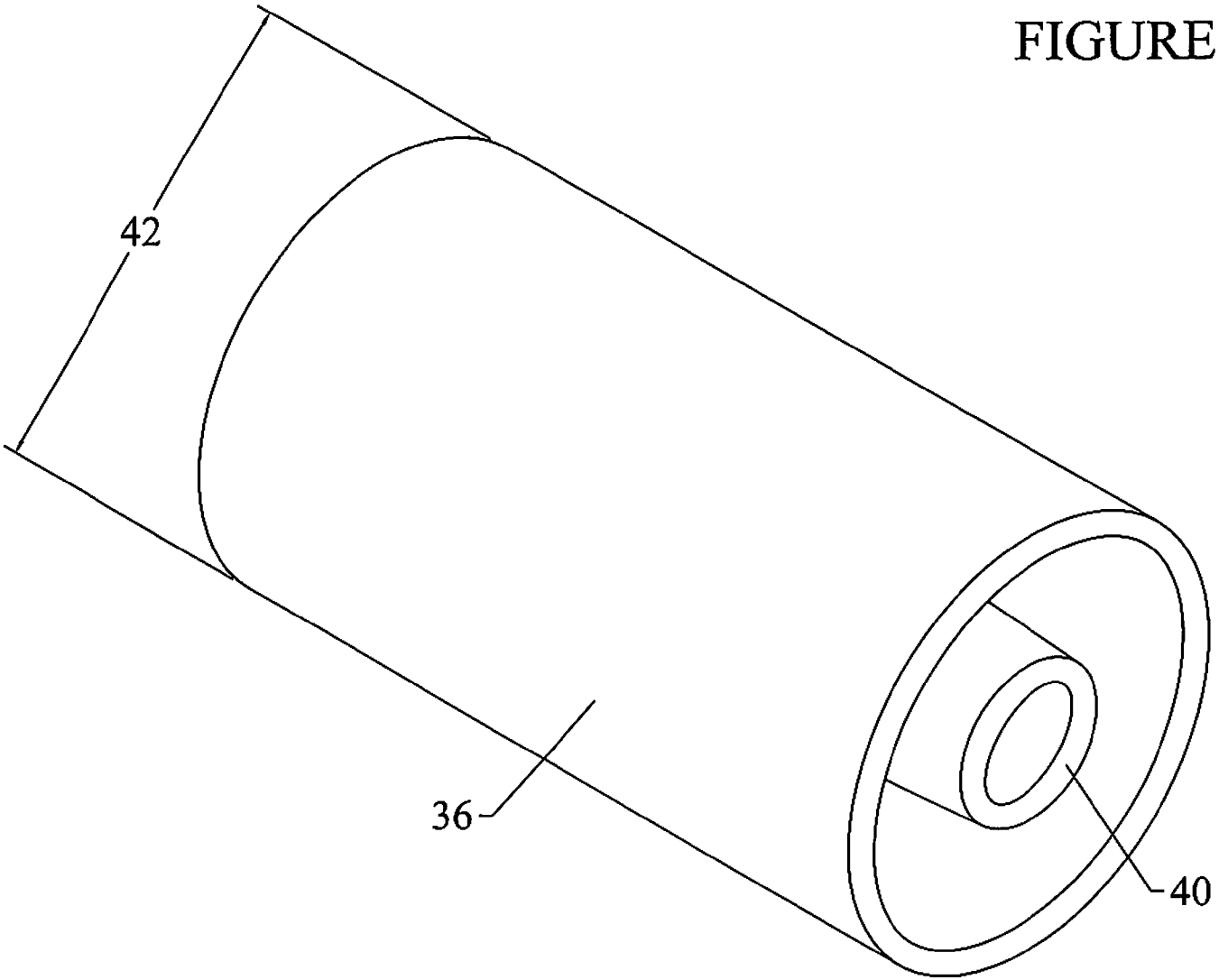
FIG. 4 is a view of a roller.

FIG. 4 shows a perspective view of an embodiment of a roller 36 usable to rotate around an axel. If a two roller embodiment is used, each roller can have a roller shaft support 40 and a roller diameter 42. If a second roller is used with the first roller on the axel, then a second roller can have a shape substantially similar to the first, with a matching roller shaft support and a substantially similar roller diameter. The diameter of the roller shaft support should be large enough enabling the first and second rollers to engage the axel and rotate freely around the axel.

It is contemplated in an embodiment that the separator on at least one side could be coated with a non-skid material to prevent the skis from slipping off the base. The non-skid material can be a thin foam or carpeting adhered or glued to the base to prevent the skis from sliding or skidding off the separator.

Figure 5:
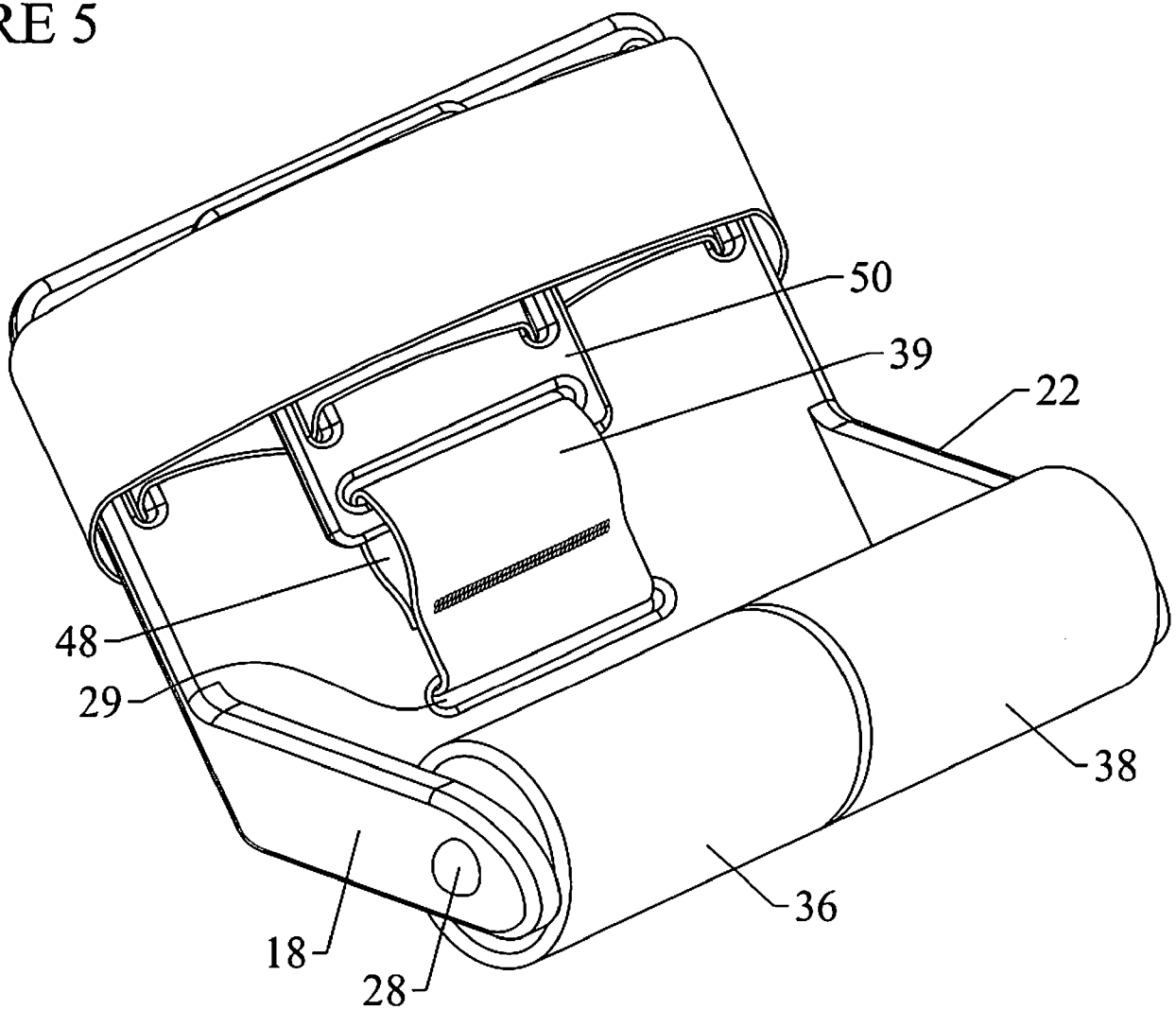
FIG. 5 is a front view of the device.

In an embodiment, as shown in FIG. 5, is a front view of the ski transport apparatus with a dual roller configuration. Rollers 36 and 38 are shown between the first and second extensions. The axel head 28 is shown on none side of the extension. This pocket sized embodiment is less than 4.5 inches in overall length and 4.5 inches in overall diameter. In this embodiment a separator strap with a thickness between ⅛$^{th}$ and ½ inch is shown. The separator strap can be a webbed strapping material, or a polyamide strap which can be a reinforced fabric, or it can be made from canvas.

In FIG. 5, the separator 10 for supporting a plurality of skis is intended to maintain a substantially parallel orientation to between the skis and in a substantially common plane. This separator has a base integrally supporting a first extension 18 with a first axel hole spaced apart from a second extension 22 with a second axel hole. This embodiment has the separator having an overall width less than about 4.5 inches and a height less than about 4.5 inches and a first separator hole in a parallel orientation to a second separator hole.

It is contemplated that the first and second separator holes are substantially perpendicular to a third separator hole 29. The separator strap 39 passes through the third separator hole 29 and into a hole of a first block 50 to reattach to itself at the first end 48. On the opposite side of the separator, the second end of the separator strap engages a second block which can not be seen in this view. It is contemplated that the first and second blocks have the same shape and placement of the holes, although different hole placement for the vertical holes of the blocks may be possible and usable herein.

Figure 6:
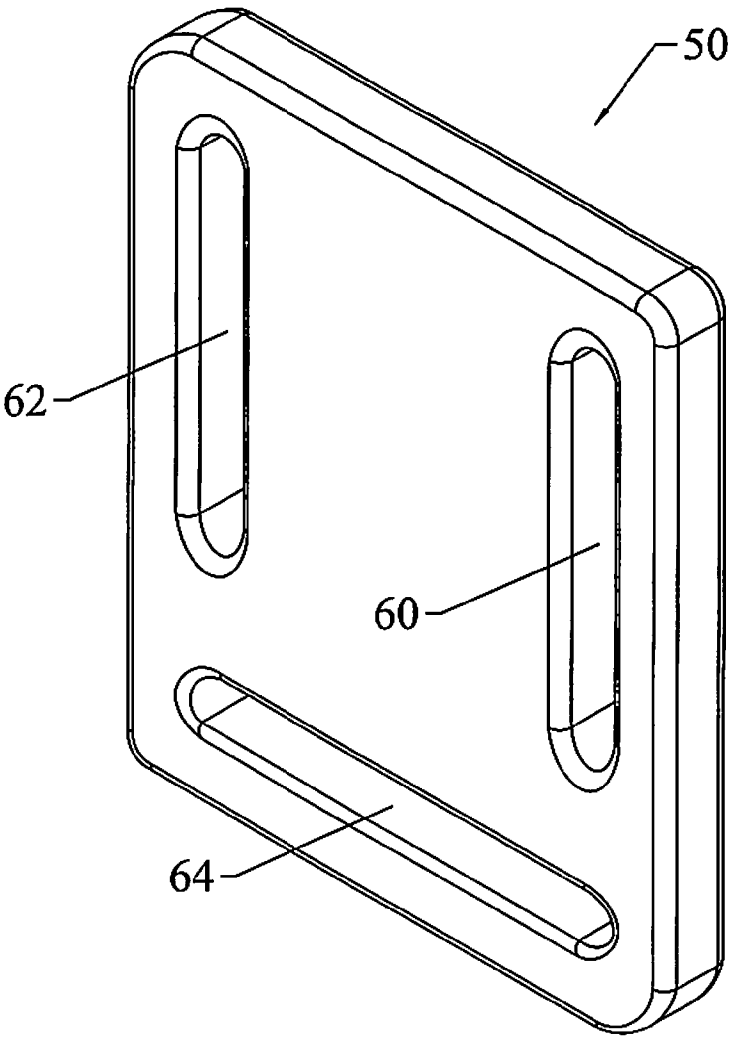
FIG. 6 is a perspective view of a block.

FIG. 6 shows a perspective view of a first block 50. These first block 50 and second block 54, not shown in this Figure, are contemplated to be non-removably engaged to each end of the separator strap. The first and second blocks can each have a horizontal block hole 64 and two parallel vertical block holes 60 and 62.

Figure 7:
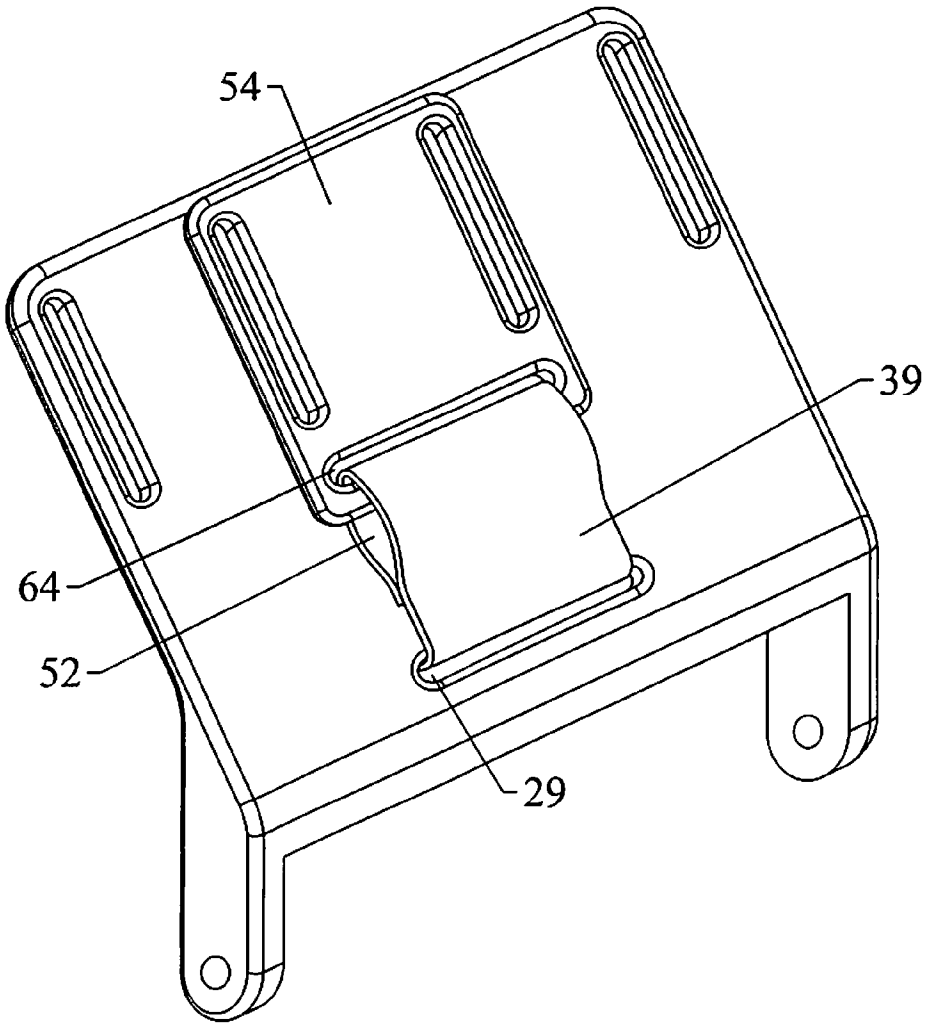
FIG. 7 is a view of the separator strap engaging a block.

FIG. 7 shows another view of the third separator hole 29 with the separator strap 39 passing through the hole and securing back to itself on the second end 52 of the strap engaging the second block 54 through a horizontal block hole 64. The separator strap can secure its ends to itself by sewing with thread, using an adhesive, such as an epoxy or using a buckle or similar fastener.

An embodiment contemplates that the separator and extensions are a one piece molded unit made from a rigid, non-deformable, lightweight polymer like polyvinyl chloride (PVC) or a crystalline hard polypropylene or polypropylene/polyethyelene copolymer or a polyamide like a nylon such as nylon 6.6.

It is contemplated that the separator can maintain a spacing between the skis equivalent to a distance within a range equivalent of about 20% to about 50% of the average thickness of a pair of skis.

Figure 8:
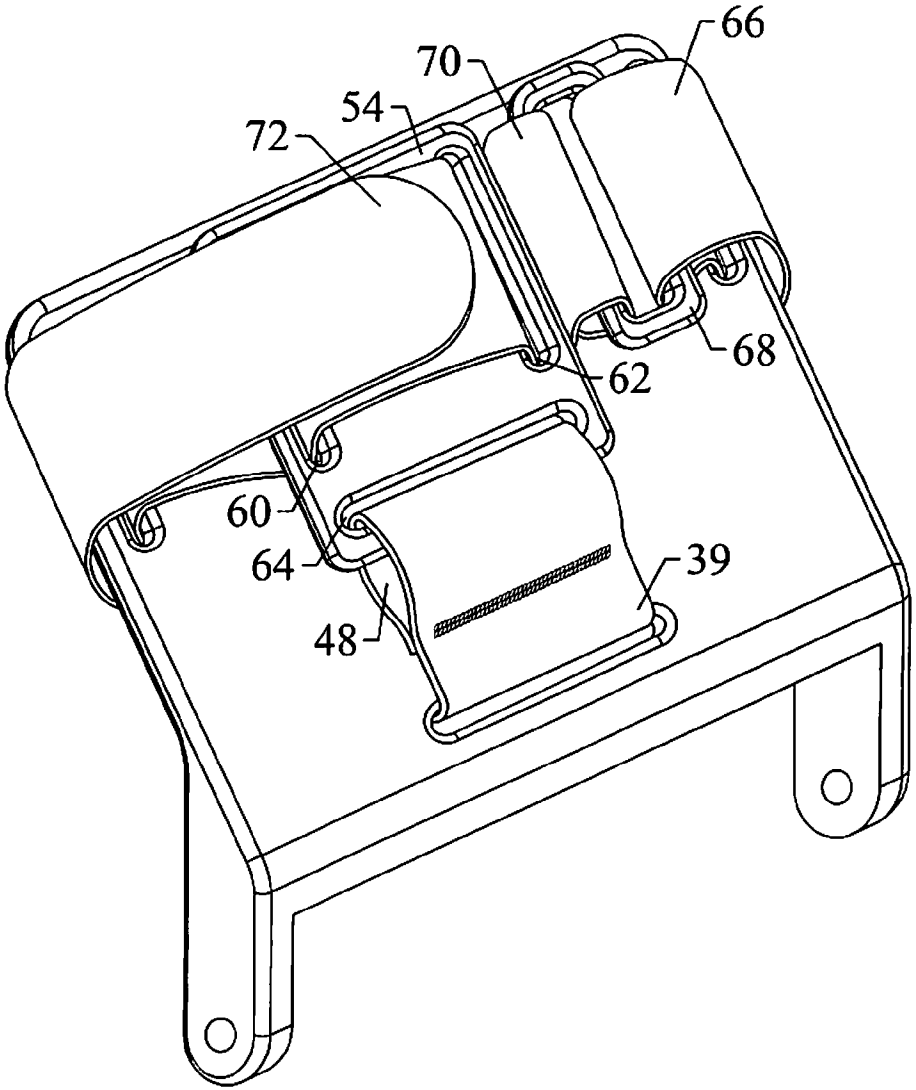
FIG. 8 is a view of the ski securing strap engaging the separator.

FIG. 8 shows the ski securing strap 66 passing through each of the vertical block holes 60 and 62 of second block 54. A ski securing strap first end 70 is secured to a buckle 68 which can be and open frame for engaging the ski securing strap second end 72.

It is contemplated that the ski strap can engages the bindings of the skis to prevent excessive movement during transport.

Figure 9:
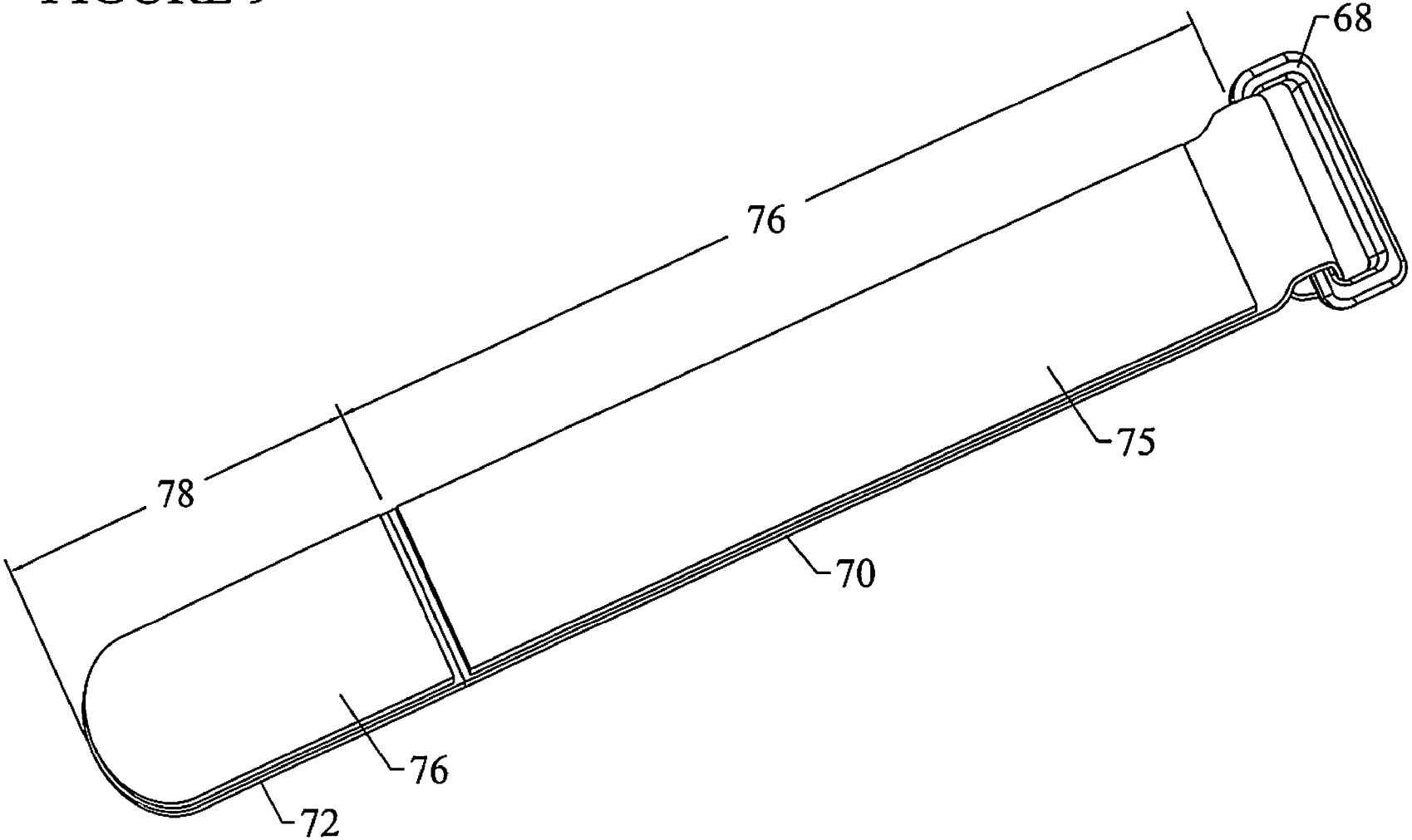
FIG. 9 is a detailed view of an embodiment of the ski securing strap.

FIG. 9 shows the ski securing strap first end 70 is secured to the buckle 68. The ski securing strap first end can be a loop portion 75 of a hook and loop fastener. The ski securing strap first end 70 can have a length ranging from about 5 inches to about 12 inches. The ski securing strap second end 72 can have a length 78 ranging from about 2 inches to about 7 inches. The ski securing strap second end 72 can include the hook portion 76 of a hook and loop fastener. Velcro™ is contemplated as a usable hook and loop material.

The ski securing strap second end 72 can wrap around the skis and the hook portion 76 can be secured to the loop portion 75, holding the skies in place.

While these embodiments have been described with emphasis on the embodiments, it should be understood that within the scope of the appended claims, the embodiments might be practiced other than as specifically described herein.

What is claimed is:

1. A pocket sized ski rolling transport apparatus comprising:

a. a separator for supporting a plurality of skis in a substantially parallel orientation to between the skis and in a substantially common plane, wherein the separator comprises a base integrally supporting a first extension with a first axel hole spaced apart from a second extension with a second axel hole; and wherein the separator has an overall width less than about 4.5 inches and a height less than about 4.5 inches and a first separator hole is in a parallel orientation to a second separator hole and wherein the first and second separator holes are substantially perpendicular to a third separator hole;

b. an axel;

c. at least one roller for encircling the axel disposed between the first and second extensions, d. a separator strap disposed through the third separator hole having a first end and a second end;

e. a first block fixedly engaging the first end and a second block fixedly engaging the second end, wherein each block has a pair of vertical block holes and a horizontal hole; and f. a ski securing strap engaging each pair of vertical block holes and having a buckle on a ski securing strap first end for engaging a ski securing strap second end and wherein the ski securing strap further engages each of the first and second separator holes.

2. The pocket sized ski transport apparatus of claim 1, wherein the axel comprises a first head secured to a first end of a shaft and a second head secured to a second end of the shaft.

3. The pocket sized ski transport apparatus of claim 1, wherein the axel comprises a first roller with a first roller shaft support and a first roller diameter and a second roller with a substantially similar second roller shaft support and a substantially similar second roller diameter and wherein the first and second rollers engage the axel through the roller shaft supports for rotating freely around the axel.

4. The pocket sized ski transport apparatus of claim 1, wherein the separator has a thickness between about ⅛ inch to about ½ inch.

5. The pocket sized ski transport apparatus of claim 1, wherein the separator strap is a webbed strapping material, a polyamide reinforced fabric, a canvas, or combinations thereof.

6. The pocket sized ski transport apparatus of claim 1, wherein the separator strap first end passes through a first block first hole and is secured to itself, and the separator strap second end passes through a second block first hole and is secured to itself.

7. The pocket sized ski transport apparatus of claim 6, wherein the separator strap is secured to itself by sewing, an adhesive, a buckle, a latch, or combinations thereof.

8. The pocket sized ski transport apparatus of claim 1, wherein the ski securing strap comprising a loop portion and a hook portion for securing the skis to the separator to prevent movement of the skis.

9. The pocket sized ski transport apparatus of claim 8, wherein the loop portion extends though the separator and the blocks.

10. The pocket sized ski transport apparatus of claim 1, wherein the separator and extensions are a one piece molded unit.

11. The pocket sized ski transport apparatus of claim 1, wherein the separator with first and second extensions are made from a rigid, non-deformable, lightweight polymer.

12. The pocket sized ski transport apparatus of claim 1, wherein the separator maintains a spacing between the skis equivalent to a distance within a range equivalent to about 20% to about 50% of the thickness of a pair of skis.

13. The pocket sized ski transport apparatus of claim 1, wherein the ski securing strap engages the bindings of the skis to prevent excessive movement during transport.

14. The pocket sized ski transport apparatus of claim 1, wherein the at least one roller is a polymeric cylinder.

15. The pocket sized ski transport apparatus of claim 1, further comprising a non-skid material disposed on at least one side of the separator to prevent the skis from falling off the separator.

* * * * *